United States Patent [19]

Zagar

[11] Patent Number: 5,070,627

[45] Date of Patent: Dec. 10, 1991

[54] DIRECTIONAL DIFFUSION NOZZLE AIR BAR

[75] Inventor: Steve J. Zagar, Green Bay, Wis.

[73] Assignee: W. R. Grace & Co.-Conn., New York, N.Y.

[21] Appl. No.: 465,470

[22] Filed: Jan. 16, 1990

[51] Int. Cl.[5] ..... F26B 13/00

[52] U.S. Cl. ..... 34/156; 34/155

[58] Field of Search ..... 34/155, 156, 23

[56] References Cited

U.S. PATENT DOCUMENTS

| | | | |
|---|---|---|---|
| 3,771,236 | 11/1973 | Candor et al. | 34/23 |
| 3,857,673 | 12/1974 | Andrus | 34/155 |
| 4,268,976 | 5/1981 | Dove | 34/155 |
| 4,328,626 | 5/1982 | Leitner | 34/155 |
| 4,468,937 | 9/1984 | Bertoldi | 34/155 |
| 4,869,157 | 9/1989 | Hungerford | 98/40.16 |

*Primary Examiner*—Henry A. Bennet
*Assistant Examiner*—Denise L. Gromada
*Attorney, Agent, or Firm*—Hugh D. Jaeger; Kevin S. Lemack; William L. Baker

[57] ABSTRACT

A directional diffusion nozzle air bar for utilizing an arrangement of holes to discharge air from a partial round member in the form of circular jets. The direction of discharge of the air is adjustable by a rotatable baffle rotatably mounted within the partial round member. The partial round member includes a plurality of holes along the length of the diffusion nozzle. The air bar provides the ability to adjust the angle of impingement of air on a web by alternating the direction of the circular jets without changing out the air bar. The air bag also provides the ability to profile the drying rate within a specific zone by directing the impingement air from each air bar.

10 Claims, 6 Drawing Sheets

DIRECTIONAL DIFFUSION NOZZLE AIR BAR

CROSS REFERENCES TO CO-PENDING APPLICATIONS

This patent application is related to a co-pending patent application entitled "Rotatable Slot Nozzle Air Bar", U.S. Ser. No. 07/465,771, filed Jan. 16, 1990, by Steven J. Zagar, and assigned to the same assignee as this patent application.

BACKGROUND OF THE INVENTION

1. Field of the Invention

The present invention pertains to air bars for drying, and more particularly, pertains to a directional diffusion nozzle air bar for directional diffusion of air.

2. Description of the Prior Art

Various coatings applied to webs in the production of products, such as photosensitive films, require drying of the coatings with circulating air. In many cases, the direct impingement of circulating air on the wet coating of the film resulted in undesired movement of the wet coating caused by blowing air on the coating surface before the coating had sufficiently set. The prior art drying systems required continual adjustment so as to avoid disturbances of the wet coating and including the reducing or eliminating of direct impingement of air, such as from air jets of an air bar, while the coating was wet and not set.

Prior art methods of drying wet coatings usually have not changed the direction of the impinging air. Dampered air nozzles of air bars reduced the jet velocity from the dampered air nozzles, but also reduced the total mass air flow in the dampered air bars. Other prior art system involved the retraction of the air bars from the web, but this proved ineffective, in that the distance of the air bars from the web increased and did not provide for a profiling air velocity within a given zone or over a given distance of the web. J. Larry Chance describes the effects of varying hole spacing and web to nozzle distance in "Experimental Investigation of Air Impingement Heat Transfer Under an Array of Round Jets", Tappi, Volume 57, No. 6, June, 1974.

It has been difficult for the prior designs of drying systems to provide a match of an exact drying profile for a specific coating on a web, such as a photosensitive film, over a prescribed distance of the dryer length.

The present invention overcomes the disadvantages of the prior art by providing an air bar with an adjustable baffle which can be rotated to change the direction of air flow from the directional diffusion nozzle air bar.

SUMMARY OF THE INVENTION

The general purpose of the present invention is an air bar with an adjustable baffle in the nozzle which is a partial round member with a plurality of holes. The adjustable baffle provides for adjusting the intensity of the direct impingement air jets on a coated web within a given zone, so as to profile the air flow to dry and set the coating of the web for the web flow direction.

According to one embodiment of the present invention, there is provided an air bar including a feed port, a flow distribution chamber, a nozzle connected to the flow distribution chamber which is a partial round, including a plurality of holes in a lower portion of the partial round. The flow distribution chamber and nozzle include solid ends. At least one rotatable baffle is rotatably secured between the ends, positioned at substantially the center of the partial round, and extending to the inner circumference of the partial round including a seal wiper at each of the outer ends of the rotatable baffle. Preferably, there are two rotatable baffles connected at a common vertex which is also the pivot axis, and a seal wiper at each end of the rotatable baffle. By rotating the baffle about the pivot axis, the air flow in the form of circular jets from the holes in the partial round of the nozzle provides for adjustable diffusion of the circular air jets towards the web.

Significant aspects and features of the present invention include an air bar with an adjustable nozzle baffle which provides a structure for varying air convection with a specific drying zone. A plurality of the rotatable slot nozzles can be utilized for enhanced drying to set and dry a coating, such as a coating on a photosensitive film web.

Other significant aspects and features of the present invention is an air bar with an adjustable nozzle baffle which enhances air movement without impinging on a wet coating on the web by providing for optimized air flow and heat transfer. Further, the air flow from the circular jets can be optimized to avoid any disturbances in the early stages of drying the coating on the web.

Having thus described the embodiments of the present invention, it is a principal object hereof to provide an air bar with an adjustable baffle in the nozzle.

One object of the present invention is a nozzle with a partial round including a plurality of holes in the lower portion of the partial round, and one or two baffles at an angle with respect to each other which rotate about a longitudinal axis of the partial round.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
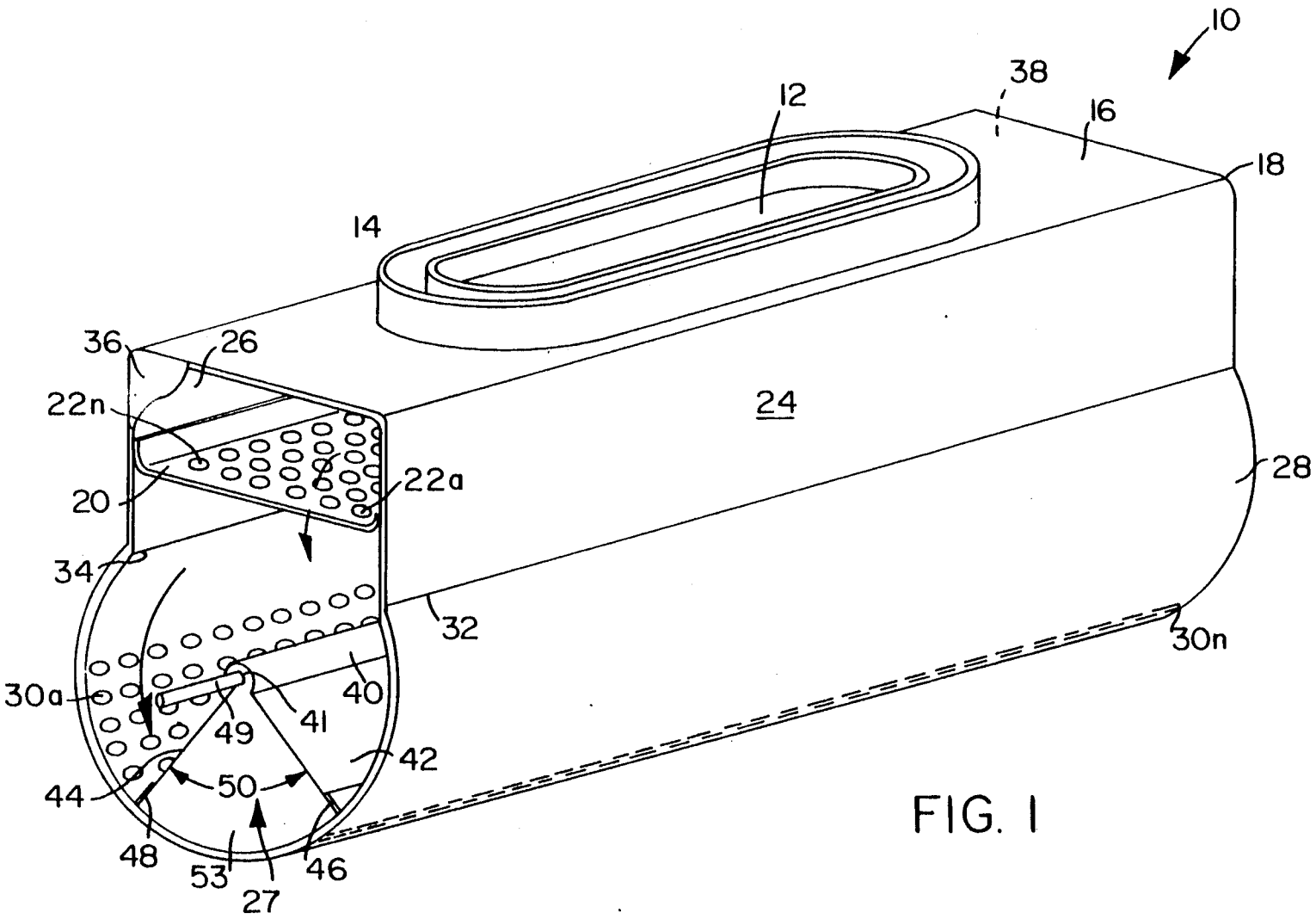
FIG. 1 illustrates a perspective view in cut away of an air bar with a directional diffusion nozzle.
Figure 2:
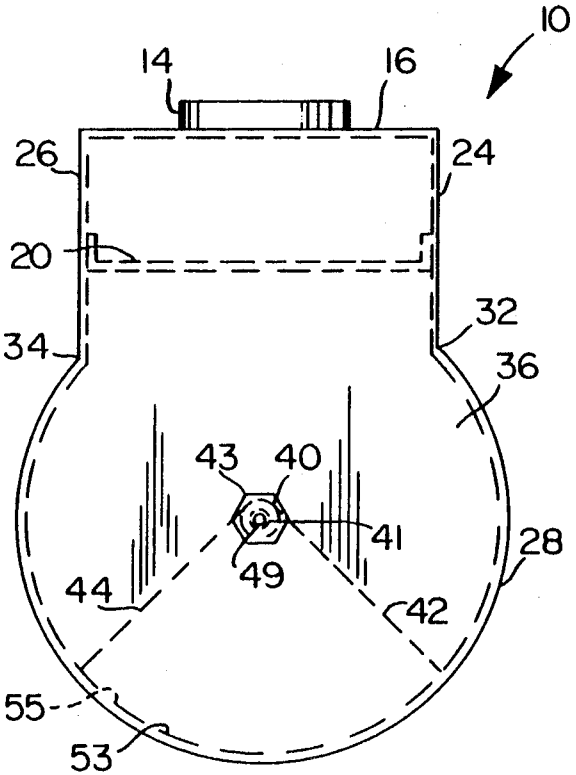
FIG. 2 illustrates an end view of an air bar.
Figure 3:
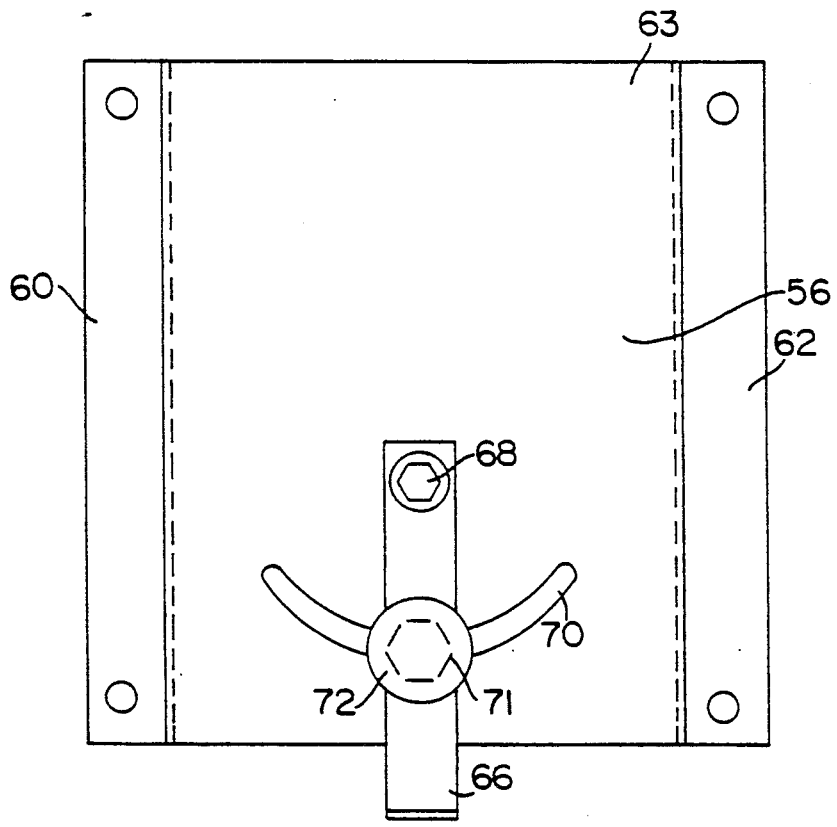
FIG. 3 illustrates an end view of an adjustment bracket including an external handle to adjust to the position of the baffle within the nozzle.

FIG. 1 illustrates a perspective view in cut away of an air bar 10 with a directional diffusion nozzle as later described in detail. The air bar 10 includes a feed port 12 including a gasket flange 14 in a central top plate 16 of a rectangular like chamber member 18, also referred to as a flow distribution chamber. An optional diffusion plate 20 with a plurality of diffusion holes **22*a*–22*n* secures to a mid-point of the sides 24 and 26 of the chamber member 18. An adjustable air baffle 27 aligns within a partial round member 28 with a radial curvature and includes a centrally located rod 40, baffles 42** and 44 and end plates 53 and 55 as later described in detail. The partial round member 28 including a plurality of circular jet holes 30a–30n and secures to the bottom edges 32 and 34 of the chamber member 18. End plates 36 (shown partially cutaway) and 38 secure to the chamber member 18 and the partial round member 28, as also illustrated in FIGS. 2 and 3. A centrally located rod 40 extends along the longitudinal axis of the partial round member 28, and between the end plates 36 and 38. Baffles 42 and 44 can secure about the centrally located rod 40, or in this instance, are bent about the centrally located rod 40 with a predetermined angle 50 therebetween. The angle 50 can be any suitable angle in the range of 10°–120°. While in this embodiment two baffles are disclosed by way of example and for purposes of illustration only and not to be construed as limiting of the present invention, the teachings of the disclosure of the present invention can include a single baffle mounted on the centrally located rod 40. The baffles can also be constructed so as to be adjustable with respect to each other about the pivot axis. Each of the baffles 42 and 4 include optional seal wipers 46 and 48, such as polymer members or reinforced gasket type polymer members which secure to each outer end of the baffles 42 and 44, such as with rivets, nuts and bolts, or any other suitable adhesives or mechanical securing structures. The centrally located rod 40 extends outwardly through the end plates 36 and 38. Packing glands 43 and 45 (not illustrated) provide the pivot support and are used for sealing the openings in end plates 36 and 38. A plate 53 extends between the ends of the baffles 42 and 44 as illustrated. A corresponding plate 55 (not illustrated) extends between the opposing ends of the baffles 42 and 44.

FIG. 2 illustrates an end view of the directional diffusion nozzle air bar 10 where all numeral correspond to those elements previously described. This figure illustrates the end plate 36.

FIG. 3 illustrates an end view of a bracket 56 for securing the baffles in a predetermined position where all numerals correspond to those elements previously described. The bracket 56 includes mounting right angled flanges 60 and 62 and a raised planar portion 63 therebetween. The bracket 56 aligns with the end plate 36 of the air bar 10 and is attached by screws or other suitable means. The centrally located rod 40 of FIG. 2 extends through the spaced planar portion 63 of the bracket 56, and secures to the adjustment handle 66 with a keyed fit and retained by bolt 68 or other suitable means, such as welding, to allow for rotational adjustment of the baffles 42 and 44 which are secured over and about the centrally located rod 40. A semicircular slot 70 is included in the raised planar portion 63 for accommodating threaded bolt 71 and a securing knob 72 which secure the handle 66 in a predetermined position, thereby securing the baffles 42 and 44 in a predetermined position.

Figure 4:
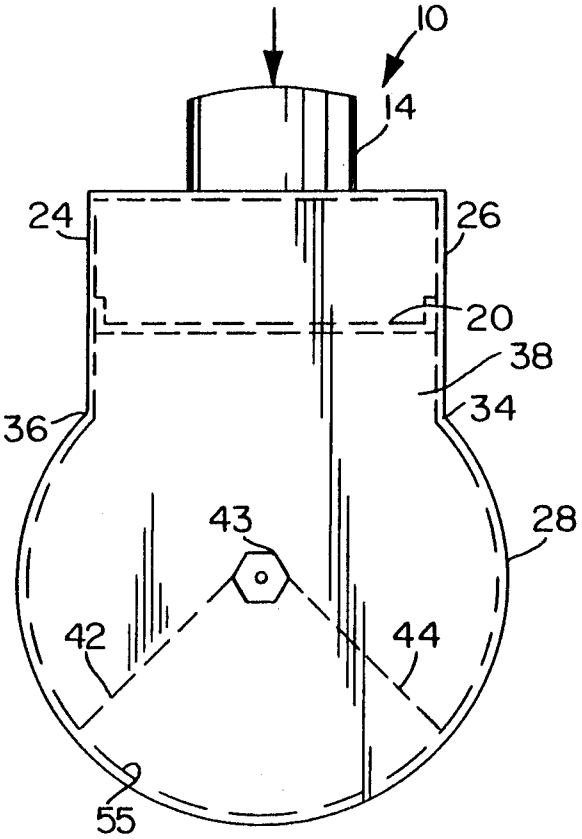
FIG. 4 illustrates an end view of the air bar.

FIG. 4 illustrates an end view of the air bar 10 including end plate 38 and the plate 55 located between the baffles 42 and 44. All other numerals correspond to those elements previously described.

Figure 5:
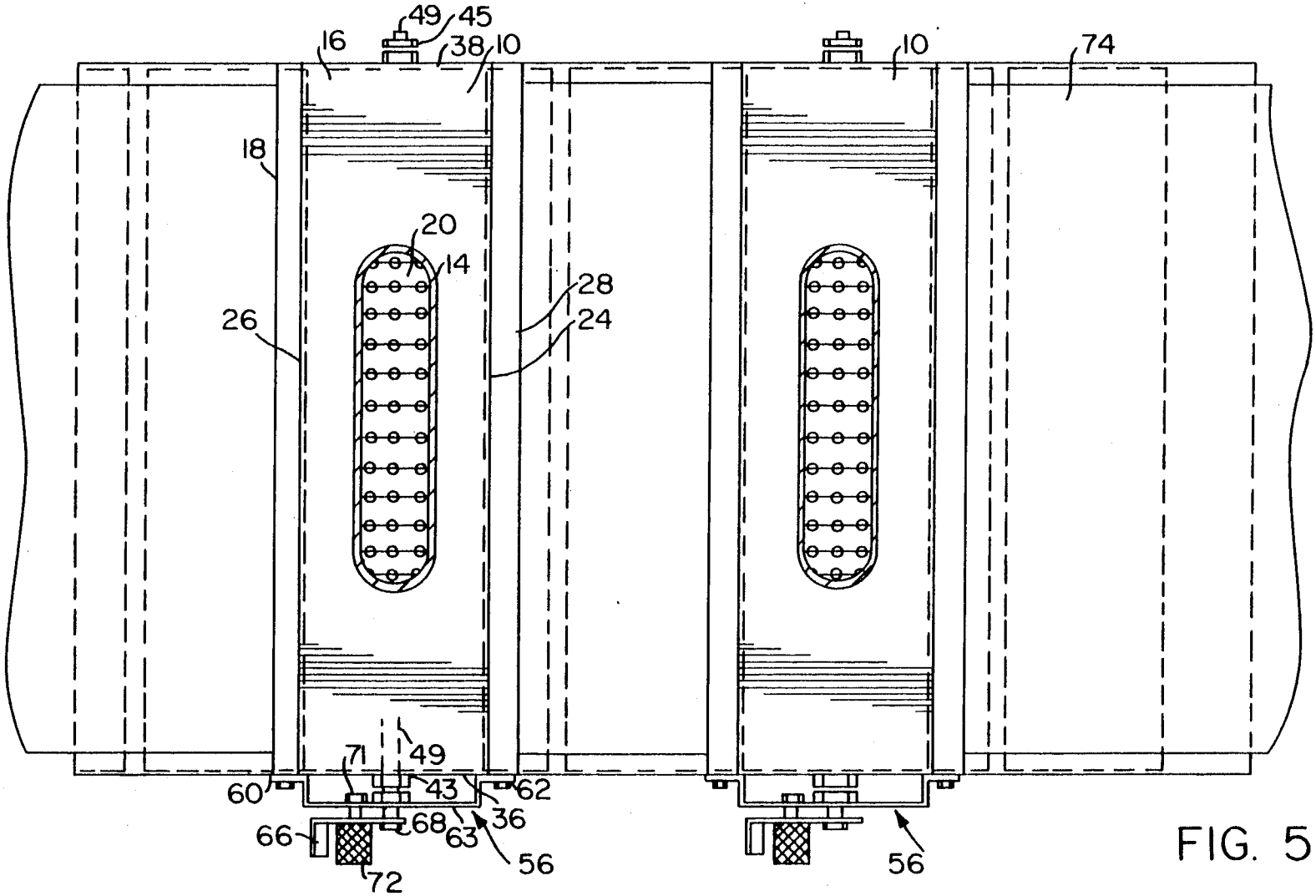
FIG. 5 illustrates a top view of an air bar over a web.

FIG. 5 illustrates a top view of two air bars 10 located over a web 74 where all numerals correspond to those elements previously described. Flanges 60 and their attendant components are aligned with the air bars 10 for rotational control of the adjustable air baffles.

Figure 6:
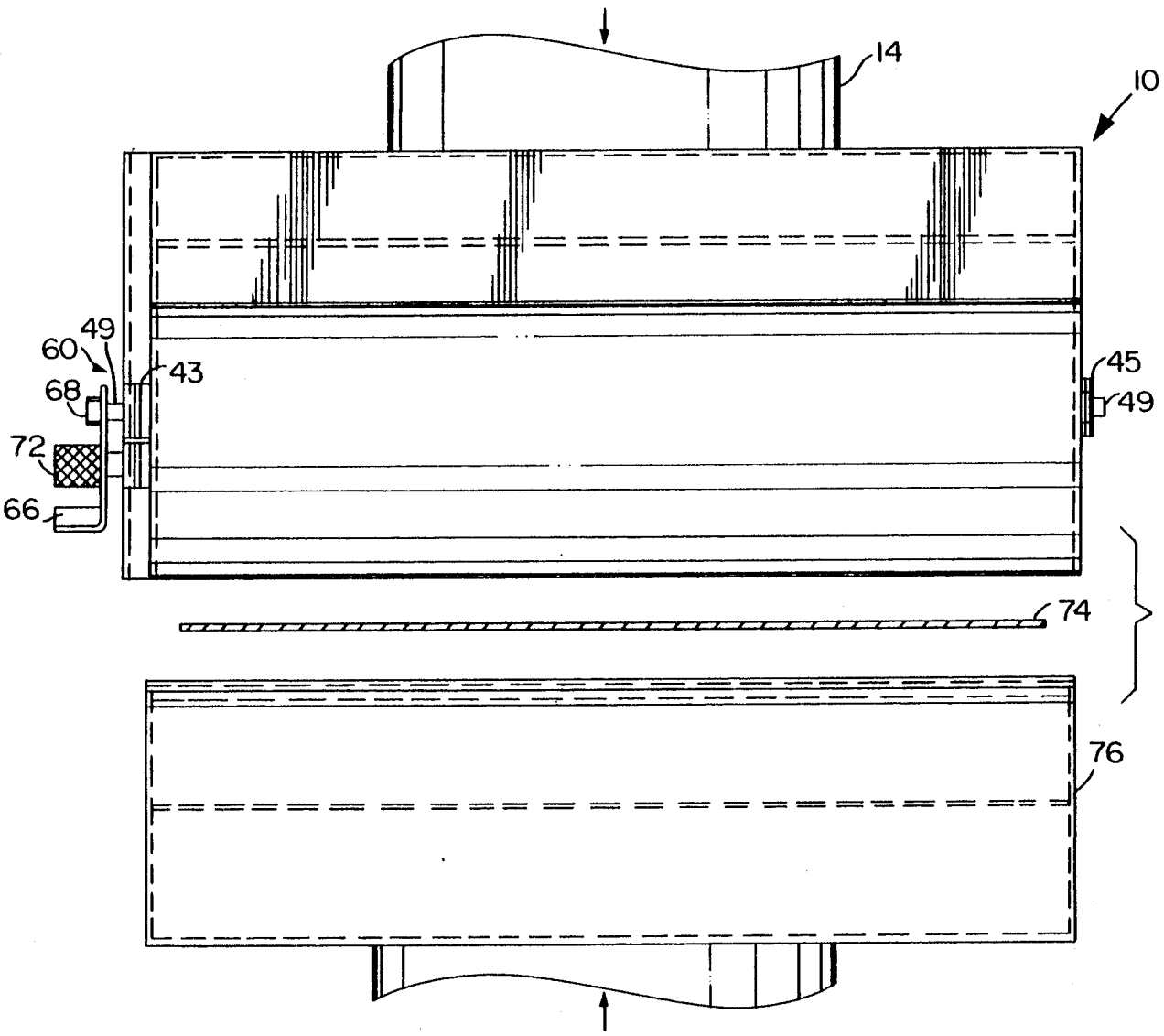
FIG. 6 illustrates an end view of an air bar over a web.

FIG. 6 illustrates an end view of a web 74 between an air bar 10 and an air foil 76 where all numerals correspond to those elements previously described.

MODE OF OPERATION

Figure 7:
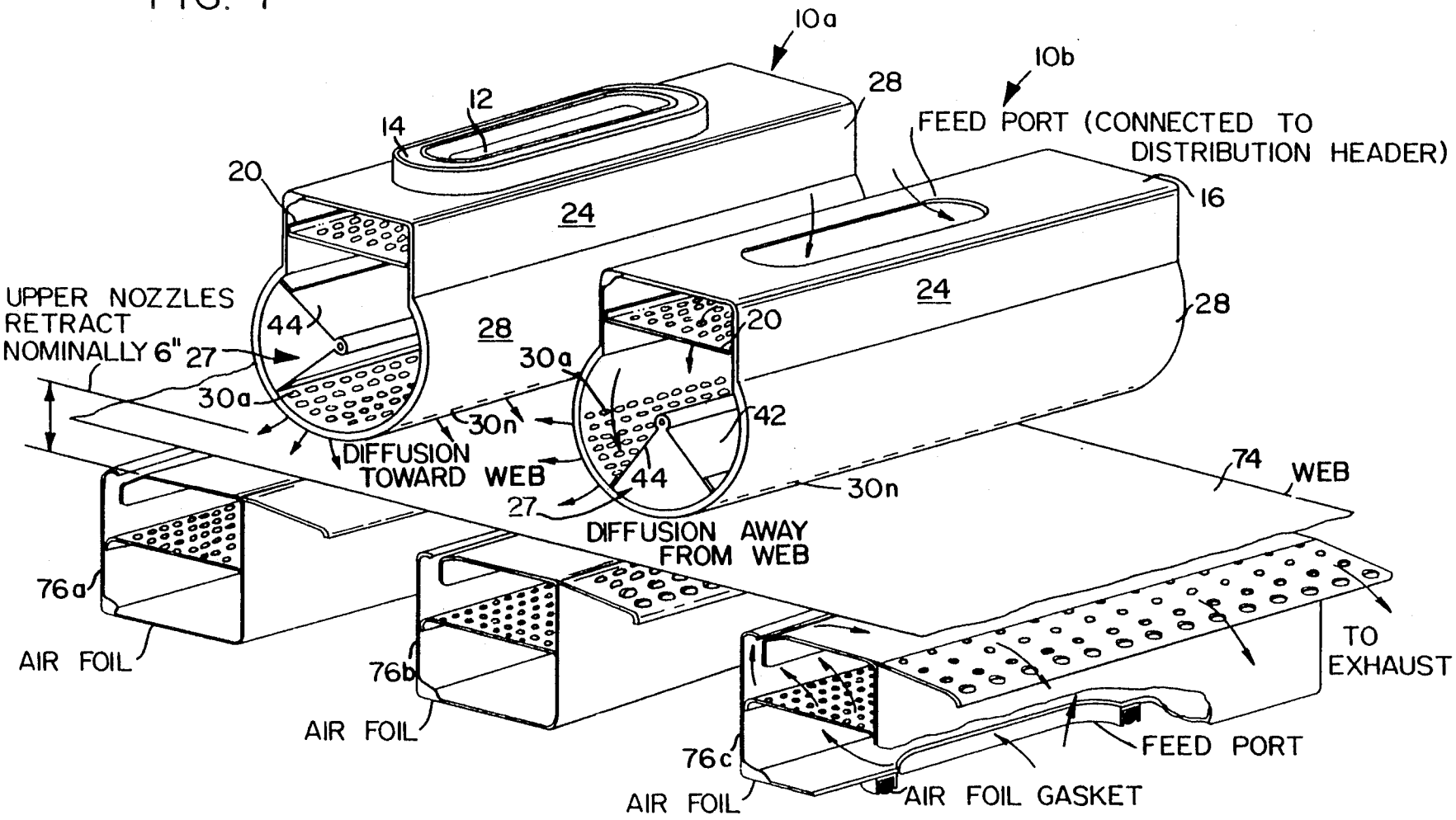
FIG. 7 illustrates the mode of operation.

FIG. 7 best illustrates the mode of operation of the plurality of air bars 10 where all numerals correspond to those elements previously described. Air bars 10a and 10b, each similar and like the air bar 10, align over and above the web 74. A plurality of air foils including air foils 76a, 76b and 76c are located on the underside of the web to provide flotation. Optionally, the web may be supported by other structures such as idler rolls. The air bar 10a is aligned above and between the air foils 76a and 76b, and the air bar 10b is aligned above and between the air foils 76b and 76c. This same alternating arrangement of the air bars and air foils continue along the length of the web for a desired distance. The air bars and air foils connect to headers for appropriate supply of air such as in a dryer like that disclosed in U.S. Pat. No. 3,739,498, entitled "High Velocity Air Web Dryer", and assigned to the same assignee of this patent application by way of example and for purposes of illustration only and not to be construed as limiting of the present invention.

The adjustable air baffle 27 is adjusted by the handle 6 discussed in the previous figures to rotationally position the baffles to obtain the desired drying air flow out of the circular jet holes 30a–30n. Adjustable air baffle 27 in the air bar 10a is essentially positioned at the 9 o'clock position, causing air from the diffusion plate 20 to flow around baffle 44 and through the plurality of holes not covered by the adjustable air baffle 27, i.e. the circular jets from the 8 o'clock position to the 4 o'clock position. The drying air impinges directly on web 74. In the air bar 10b, the adjustable air baffle 27 is positioned at the 6 o'clock position, causing air from the diffusion plate 20 to flow around the baffle 44 and out the circular jet holes 30a–30n, not restricted by the baffles 42 and 44. Air flows to the side and out of the circular jet holes 30a–30n and across the web 74 instead of directly straight on impingement as depicted beneath the air bar 10a. Generally, the impinging air from the air bar 10b flows from the circular jets located between the 9 o'clock and 7 o'clock positions. While in this embodiment, two positions for the adjustable air baffle 27 are disclosed by way of example and for purposes of illustration only and not to be construed as limiting of the present invention, the teachings of the disclosure can include different positioning of the adjustable air baffle 27.

In one of the modes of operation, a drying zone having a plurality of the directional diffusion nozzles is configured as illustrated in FIG. 7. Starting from the first nozzle nearest the web entering end of the zone, adjustable air baffle 27 is positioned by means of adjustment handle 66 such that the air from jet holes 30a–30n are directed at angles substantially less than perpendicular to the surface of web 74. The air jets do not impinge on the web surface and induce surrounding air into motion by entrainment, thereby effecting minimal air convection forces on the wet coating. Adjacent nozzles in the direction of web travel are similarly adjusted until the coating has set sufficiently so as to be tolerant of greater air convection forces without disturbance of the coating. Subsequent nozzles in the direction of web travel are adjusted so as to position their respective adjustable air baffles to direct the air jets at progressively greater angles of incidence to the web. The angles may increase up to and including perpendicular impingement for increased heat and mass transfer effectiveness.

Having thus described the preferred modes of the present invention, those of skill in the art will be readily able to apply the teaching found herein to various other systems to apply pressurized gas to a traveling web of material at an adjustable impingement angle without deviating from the scope of the claims hereto attached.

I claim:

1. Apparatus for directing stream of gas into contact with a floating substantially longitudinal traveling web of material comprising:

a. housing mounted adjacent to said traveling web of material;

b. source of pressurized gas coupled to said housing;

c. means coupled to said housing for directing said pressurized gas out of said housing and into contact with said traveling web of material; and, d. means rotatably positioned in said directing means for changing the angle of impingement of said pressurized gas with said traveling web of material.

2. Apparatus according to claim 1 wherein said directing means further comprises a plurality of apertures in a portion of said housing.

3. Apparatus according to claim 2 wherein said changing means further comprises a baffle for directing said pressurized gas away from a portion of said plurality of apertures.

4. Apparatus according to claim 3 wherein said portion of said housing is partially cylindrical having a radius of curvature.

5. Apparatus according to claim 4 wherein said baffle is rotatable about said radius of curvature.

6. Apparatus for directing a stream of air into contact with a floating substantially longitudinal traveling web of material comprising:

a. a partially cylindrical housing mounted adjacent to a traveling web of material and including a plurality of apertures in a lower portion of said housing;

b. source of pressurized air coupled to said housing;

c. means coupled to said housing for directing said pressurized air out of said housing and into contact with said traveling web of material; and, d. means rotatably positioned in said directing means for changing the angle of impingement of said pressurized air with said traveling web of material.

7. Directional air bar for a substantially longitudinal traveling web comprising:

a. a feed port for connection to a flow distribution chamber, said flow distribution chamber connected to said feed port;

b. a partial round member connected to said flow distribution chamber, a plurality of holes in a lower portion of said partial round member and ends secured thereto; and, c. at least one rotatable baffle rotatably mounted between ends of said partial round member and means securing said rotatable baffle in said partial round member.

8. Directional air bars for a substantially longitudinal traveling web comprising:

a. feed ports for connection to a flow distribution chamber, said flow distribution chambers connected to said feed ports;

b. partial round members connected to said flow distribution chambers, a plurality of holes in a lower portion of said round members and ends secured thereto; and, c. rotatable baffles rotatably mounted between ends of said partial round members at an angle with respect to each other and means securing said baffles in said partial round members.

9. Directional air bar of claim 8 comprising a diffusion plate in said flow distribution chamber.

10. Directional diffusion nozzle air bar comprising:

a. a feed port for connection to a flow distribution chamber;

b. a stationary flow distribution chamber connected to said feed port;

c. a partial round nozzle member connected to said flow distribution chamber, a plurality of holes in a lower portion of said partial round nozzle member and ends secured thereto;

d. at least one rotatable baffle rotatably mounted between ends of said partial round nozzle member and means securing said baffle in said partial round member; and, e. a substantially longitudinal planar web spaced at a distance from said partial round nozzle member for air impingement.

* * * * *